US005555819A

United States Patent [19]

Lochridge

[11] Patent Number: 5,555,819

[45] Date of Patent: Sep. 17, 1996

[54] WORK STATION HAVING AN ADJUSTABLE WORK SURFACE

[75] Inventor: Edwin P. Lochridge, Atlanta, Ga.

[73] Assignee: Metamorphosis Design & Development, Atlanta, Ga.

[21] Appl. No.: 384,572

[22] Filed: Feb. 6, 1995

Related U.S. Application Data

[63] Continuation-in-part of Ser. No. 100,158, Aug. 2, 1993, abandoned.

[51] Int. Cl.[6] ..... A47F 5/12

[52] U.S. Cl. ..... 108/9; 108/1

[58] Field of Search ..... 108/1, 6, 9; 248/456, 248/454, 371, 407, 242

[56] References Cited

U.S. PATENT DOCUMENTS

| | | | |
|---|---|---|---|
| 881,492 | 3/1908 | Schiller | 108/9 X |
| 1,121,713 | 12/1914 | Cogger . | |
| 1,652,792 | 12/1927 | Nagy . | |
| 2,795,891 | 6/1957 | Bishop . | |
| 2,931,685 | 4/1960 | Butler . | |
| 4,350,098 | 9/1982 | Shirono et al. . | |
| 5,005,669 | 4/1991 | Umebara et al. . | |
| 5,044,284 | 9/1991 | Gross . | |
| 5,410,971 | 5/1995 | Golden et al. | 108/1 X |

FOREIGN PATENT DOCUMENTS

| | | | |
|---|---|---|---|
| 0128263 | 12/1984 | European Pat. Off. . | |
| 3614733 | 11/1987 | Germany | 108/1 |
| 833472 | 4/1960 | United Kingdom | 108/6 |
| 1102922 | 2/1968 | United Kingdom . | |

*Primary Examiner*—Jose V. Chen

*Attorney, Agent, or Firm*—Merchant, Gould, Smith, Edell, Welter & Schmidt, P.A.

[57] ABSTRACT

An adjustment mechanism for a tiltable work surface. The adjustment mechanism includes an adjustment bar having notched flanges. The notches are selectively engageable with pins projecting from a support to selectively fix the work surface at a desired degree of tilt. In this way, the user can easily and quickly adjust the tilt angle of the work surface by simply lifting up on, and then releasing, the adjustment bar to selectively engage the desired pair of notches with the pins.

12 Claims, 7 Drawing Sheets

WORK STATION HAVING AN ADJUSTABLE WORK SURFACE

CROSS REFERENCE TO RELATED APPLICATIONS

The present application is a continuation-in-part of Ser. No. 08/100,158 filed Aug. 2, 1993 now abandoned.

FIELD OF THE INVENTION

The present invention is directed to a work station having a tiltable work surface and more specifically, to an adjustment mechanism which facilitates the ease in manual adjustment of the angle of the work surface. The term "work station" is used in a broad generic sense in the context of the present invention, and is intended to encompass a variety of structures encountered as work surfaces in an office setting, including desks, tables, stands, computer work stations, etc. The present invention also is applicable to both original and retro-fit instructions; both are considered to be within the scope of the present invention.

BACKGROUND OF THE INVENTION

Many types of mechanisms for adjusting the tilt angle of work surfaces are known. However, the mechanisms suffer from a number of deficiencies.

Most tilt mechanisms are designed in the contemplation of surfaces which pivot at or near the front (i.e., the user's side) of the surface. As such, the mechanisms are designed with the idea of resisting downward pressure (i.e., force applied by objects which are resting on the surface). A work surface which has a pivot point located more toward the middle of the surface would be beneficial, since this would tend to balance the weight of the surface and any object carried thereon, so that adjustment of the surface could be carried out with less effort and greater control. In addition, when the pivot point is positioned near the middle of the surface, the front of the surface moves down as the rear of the surface moves up, thus permitting the surface to better accommodate the user in a number of different postures. However, the pivoting of the surface at a point towards the middle of the surface requires that the adjustment mechanism resist upward force as well as downward force, since a user will put downward pressure on the front of the surface, for example, when moving to a standing position or pushing away from the work surface. This downward pressure on the front of the surface results in upward pressure at the rear of the surface. Therefore, it would be desirable to have an adjustment mechanism which is capable of withstanding both upward and downward force.

In addition, many mechanisms are slow and cumbersome to operate. They often require the user to use both hands for operation and/or require the user to stand up to perform the adjustment operation.

Another benefit of a tilted work surface is the potential increase in available knee space under the surface made available as the surface is tilted. This is especially true if the user is using a foot rest. Unfortunately, many known mechanisms disadvantageously occupy a significant amount of space under the work surface.

Also, some known mechanisms for adjusting the tilt of a work surface suffer from the possibility of collapse of the work surface when the tilting mechanism is disengaged. This creates undesired noise and vibration, and can damage objects resting on the surface or even cause injury to the user. Some mechanisms which attempt to alleviate this problem rely on numerous and delicate parts and adjustment for safe performance. The number and nature of the parts increase the likelihood of failure over the course of time, posing the threat of injury to the user and damage to equipment carried by the work surface. Such mechanisms are also expensive and difficult to manufacture, thereby limiting the applicability of the mechanisms.

Most office applications require a work surface to tilt within an angle between horizontal and 13° from horizontal. At angles larger than this, objects placed on the surface will tend to slide off the surface. Many known tilting mechanisms are not adapted to perform well within this limited range.

SUMMARY OF THE INVENTION

The present invention is directed to an adjustment mechanism and support frame for a tiltable work surface which a user can easily and quickly adjust to different tilt angles with one hand from a seated or standing position, and which permits selection of several tilt positions within a range of about 13° from horizontal. The adjustment mechanism of the present invention also does not unduly impede the knee space of the user and can be made inexpensively from a minimum number of parts having high reliability. The adjustment mechanism of the present invention resists upward as well as downward movement of the work surface when engaged, limits the range of movement of the work surface, and will not disengage unless the weight of the surface is under the control of the user, thereby preventing the collapse of the surface upon disengagement of the mechanism.

The present invention is directed to a work station which includes a support frame and a work surface pivotably mounted on the support frame. An adjustment bar is located at the lower surface of the work surface, and is pivotably secured to the work surface. The adjustment bar includes an actuating portion which is oriented generally parallel to the lower surface of the work surface, is spaced from the lower surface of the work surface, and is disposed adjacent an edge of the work surface. The adjustment bar further includes an engaging portion which extends generally perpendicularly to the lower surface of the work table, and has an edge which is provided with a plurality of notches. The support frame includes a pin which engages any one of these plurality of notches. Movement of the actuating portion of the adjustment bar toward the lower surface of the work surface causes pivoting movement of the adjustment bar, so that the pin becomes disengaged from the notches. The pin can be re-engaged with a different notch so that the work table can be set at a different angle. The pivot point of the adjustment bar is such that the release of the actuating portion will cause the edge of the engaging portion having the notches to be urged by the action of gravity in a direction toward the pin. The notches are shaped to resist disengagement from the pin due to both upward and downward force. The edge of the engaging portion can be provided with a protrusion which prevents movement of the work surface over more than a predetermined distance. The adjustment bar is designed so that the actuating portion is capable of flexing. Thus, if a user attempts to lift the adjustment bar without having the work surface under control, i.e., by slightly lifting the work surface, the actuating portion will simply flex until it contacts the lower surface of the work surface, while the notch remains engaged with its pin. The notches are shaped to resist disengagement from the pin unless the user has the work surface under control. The adjustment mechanism can be made from a minimum number of inexpensive and reliable parts, and construction can be carried out easily.

BRIEF DESCRIPTION OF THE DRAWINGS

The above aspects of the present invention are apparent from the attached figures, wherein.

DETAILED DESCRIPTION OF THE INVENTION

Figure 1:
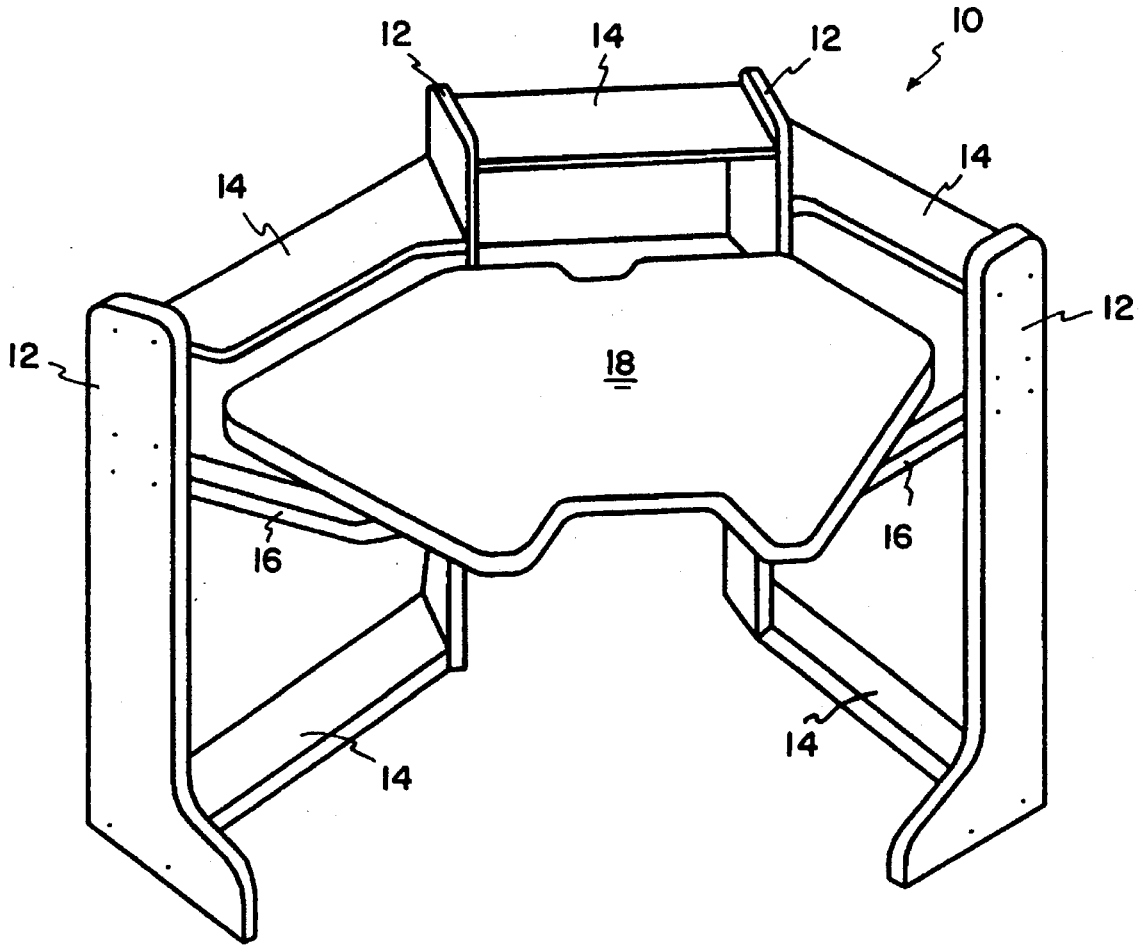
FIG. 1 is a front perspective view of a computer work station having a tiltable work surface which can be adjusted according to a preferred embodiment of the present invention.
Figure 2:
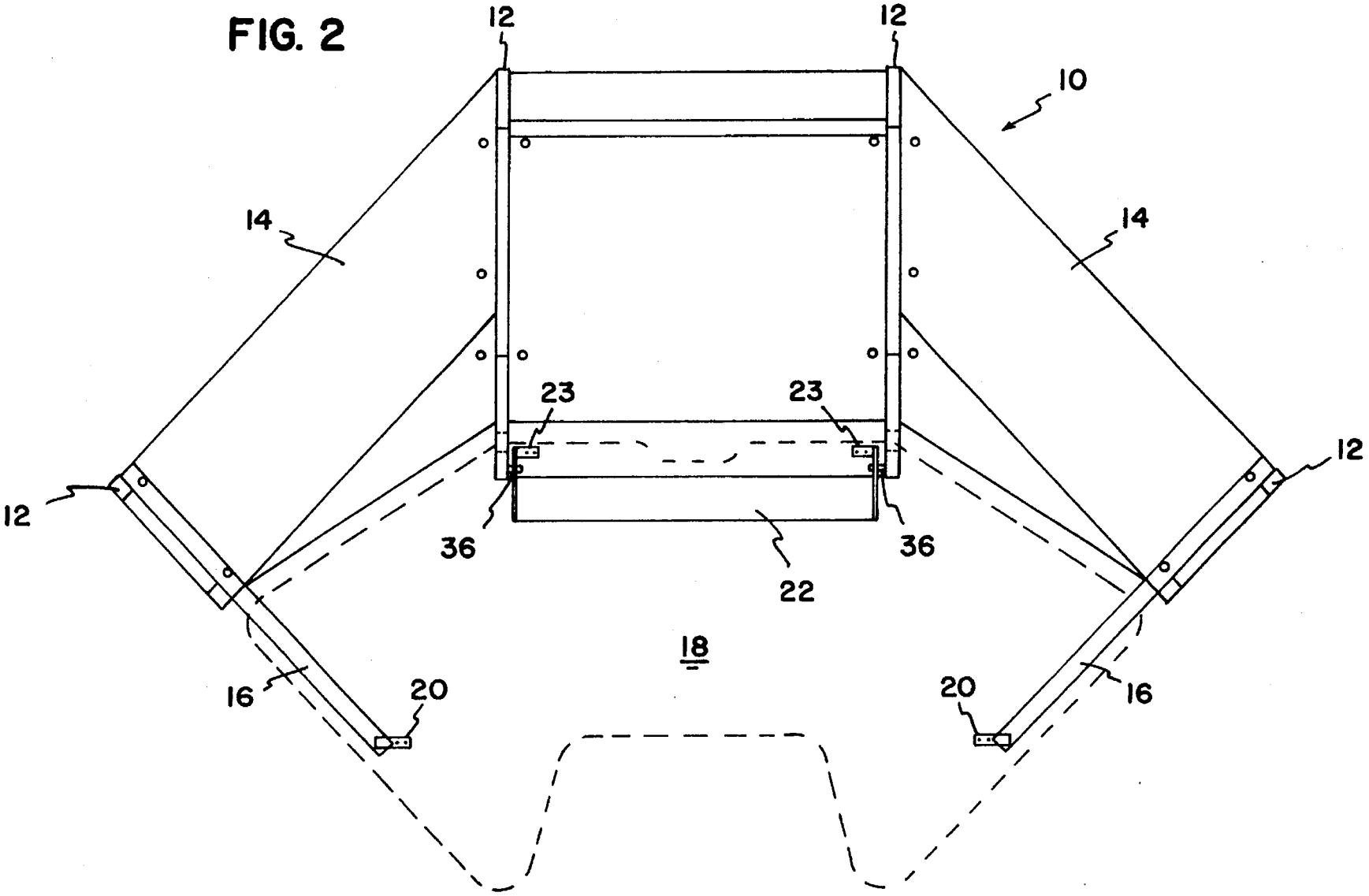
FIG. 2 is a top plan view of the work station of FIG. 1, with the work surface illustrated in phantom line and the adjustment bar shown.
Figure 3:
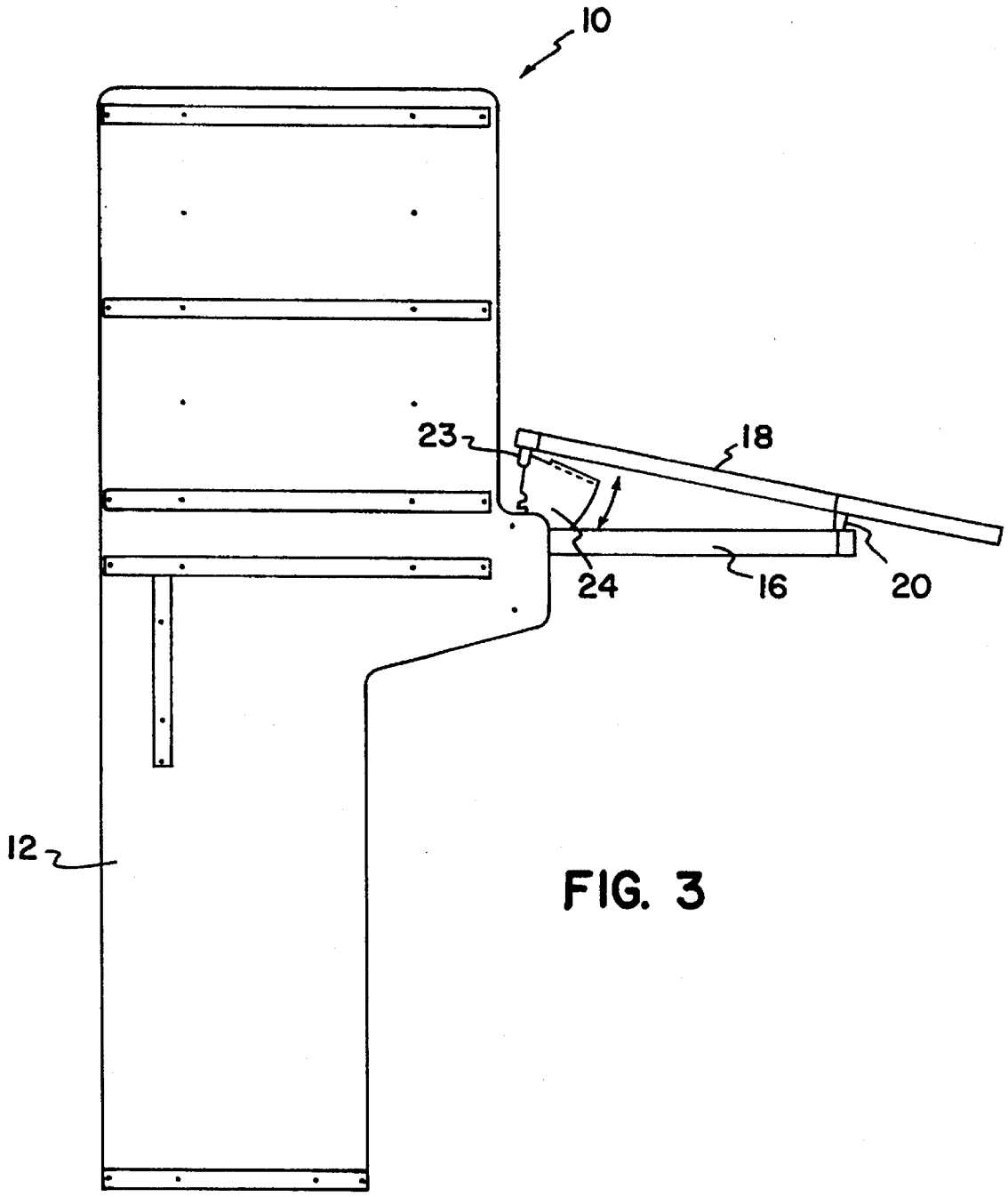
FIG. 3 is a side elevational view of the preferred embodiment of the invention with the work surface in a tilted position.

One embodiment of the present invention in the form of a computer work station having a tiltable work surface which can be adjusted is shown in FIGS. 1–3. The work station 10 includes a frame formed of uprights 12 and connecting members 14. The connecting members 14 can serve as shelves for holding a telephone, books, etc. The uprights 12 and connecting members 14 can be formed of any suitable material, such as wood, particle board, metal or the like. As discussed above, the computer work station is only one of the types of furniture in which the present invention can be used, and the present invention is equally applicable to other types of work stations, such as desks, tables, stands and the like. The present invention is also equally applicable to new or retro-fit applications.

Arms 16 preferably extend from the outer most pair of uprights 12. Tiltable work surface 18 is pivotably connected to arms 16, preferably via two pivot joints 20, as shown generally in FIGS. 2 and 3, and discussed in more detail below. The height of the arms, i.e., the distance of the arms from the floor, may be adjustable so that the horizontal or resting level of the work surface may be varied. The arms 16 could be secured to different uprights, e.g., an inner pair of uprights. In addition, since the arms 16 function to support the tiltable work surface 18, the arms 16 can assume different forms depending on the piece of furniture involved. For example, in a desk, the support arms could be secured to a desk pedestal or made integral with the desk pedestal. The precise location and configuration of the arms is not critical and as long as the work surface is tiltably supported.

For the purposes of this application, the orientation of the work surface is described from the perspective of the user. That is, the front of the work surface will be considered the edge closest to the user and the back the edge farthest from the user. The right side and left side are determined from the perspective of the user, as are the upper and lower surfaces of the work surface. The length or longitudinal aspect of the work surface refers to the dimension between the front and back portions of the work surface. The width or lateral direction of the work surface is the distance between the sides of the work surface.

Figure 4:
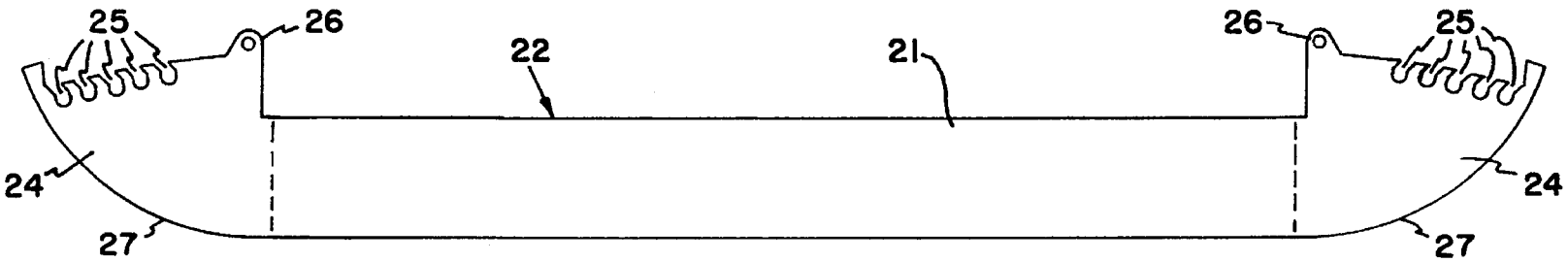
FIG. 4 is a top plan view of the adjustment bar shown in FIG. 2 before the bending of the side flanges.

As shown generally in FIG. 3, an adjustment bar 22 is pivotably connected to the work surface for movement relative to the work surface via pivot joints 23 in a manner which will be discussed in more detail below. Adjustment bar 22 is preferably formed as a unitary piece as shown in FIG. 4. The bar may be constructed with any suitable material such as metals such as steel, copper or aluminum, or various plastics or wood. One particularly suitable material is steel, for example cold rolled steel of 12 or 16 gauge.

Figure 5:
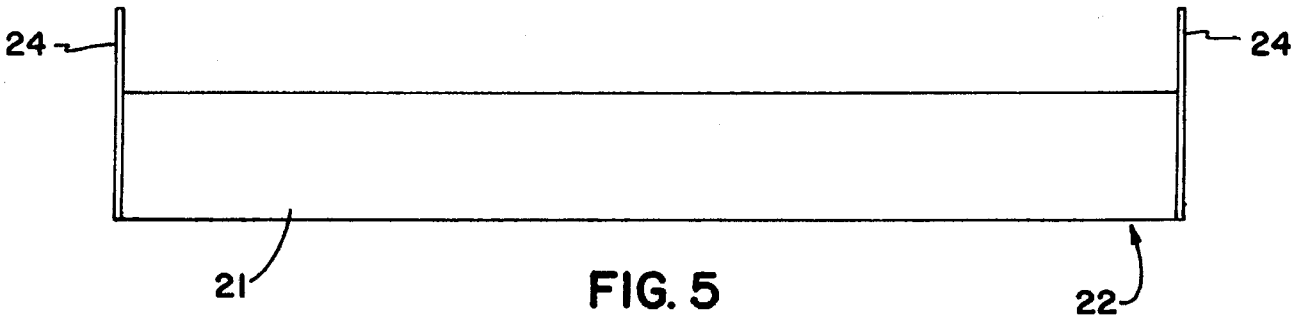
FIG. 5 is a top plan view of the adjustment bar shown in FIG. 4 after the side flanges are bent.
Figure 6:
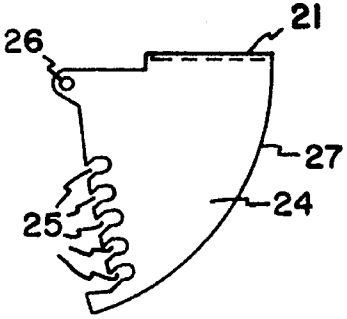
FIG. 6 is a side elevational view of the side flange of the adjustment bar shown in FIG. 5.

Preferably, the adjustment bar includes an actuating portion 21 and an engaging portion including the side flanges 24. In one embodiment, prior to installation, the bar is bent along the dotted lines shown in FIG. 4 to form the two downwardly extending flanges 24, as shown in FIGS. 5 and 6. In one embodiment, the flanges extend in a generally perpendicular direction to the actuating portion 21. While it is preferred that the engaging portion include two flanges 24, it will be apparent that a single flange could be used as well. In addition, while a one-piece adjustment bar is shown, there may be instances in which it is desirable to form the flanges from a different material from that of the actuating portion. In these cases, the flanges may be joined to the actuating portion by a suitable process such as welding, gluing or another bonding process, or with suitable fasteners, such as bolts, screws, rivets, etc. The flanges can be joined to the actuating portion at a location other than the ends of the actuating portion.

The flanges 24 include an edge which is provided with a plurality of spaced notches 25. The spaced notches 25 provide different tilt angles for the work surface 18 in a manner discussed in more detail below. Preferably, the notches permit the work surface to assume an angle in the range from, for example, horizontal to 13° from horizontal in either direction. The edge 27 opposite from the notches 25 is preferably arcuate in shape.

Figure 7:
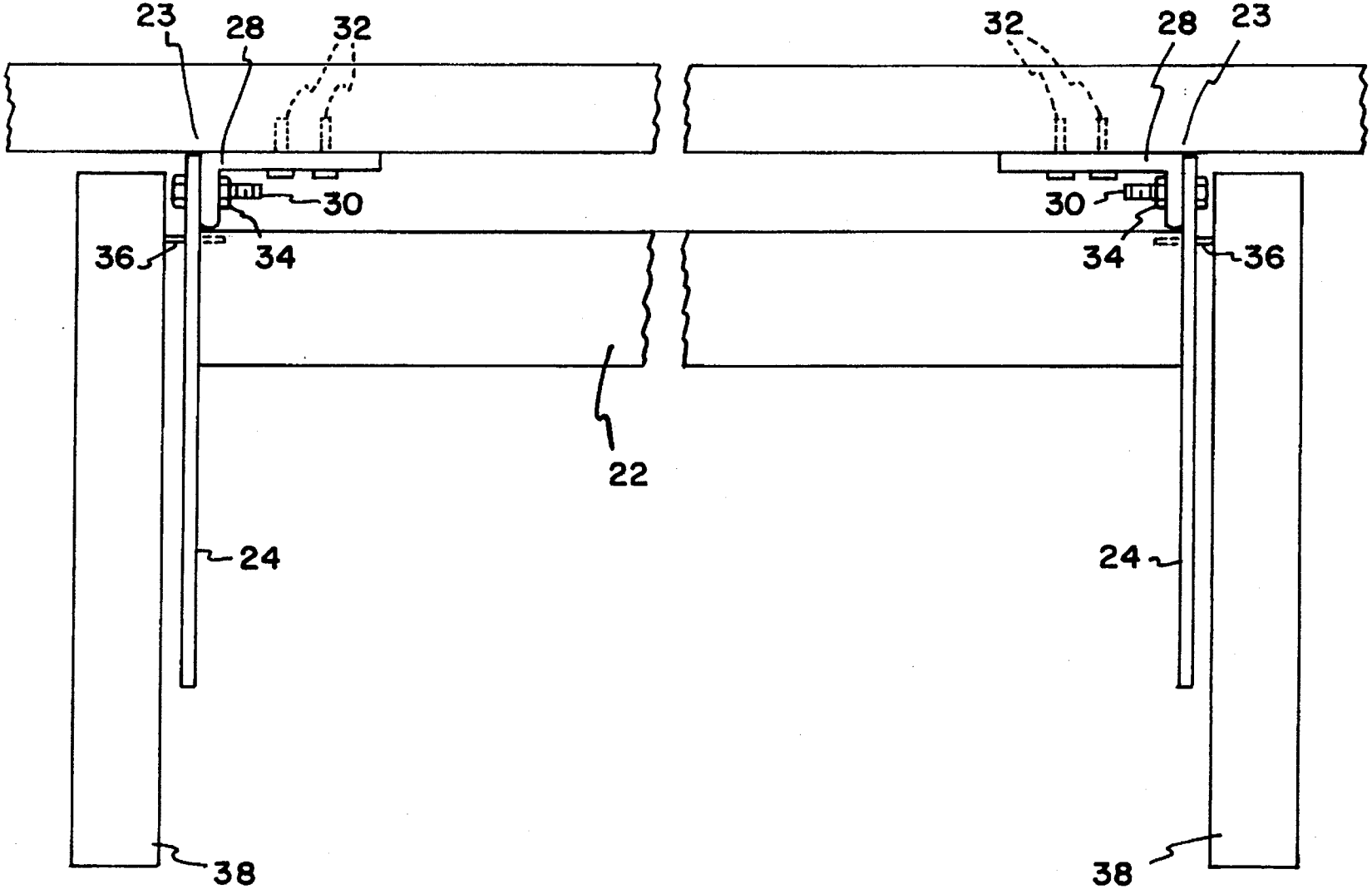
FIG. 7 is an enlarged partial front elevational view of the adjustment mechanism according to a preferred embodiment of the present invention.

Each flange also preferably includes a pivot hole 26 which cooperates with an eye hole bracket 28 and bolt 30 to form pivot 23. As shown in FIG. 7, the eye hole brackets 28 can be fixed to the underside of work surface 18 using suitable fasteners such as screws 32. Bolt 30 then extends through pivot hole 26 and eye hole bracket 28, and may be secured using lock nut 34. When the mechanism is assembled, pivot hole 26 is situated forward of the center of gravity of the adjustment bar so that gravity will urge the notches toward pins 36 as discussed below. The shape and size of the flanges 24 are selected to ensure that the center of gravity is in the desired location. Of course, any other suitable arrangement may be used as long as it permits relative pivoting motion between the adjustment bar 22 and the tiltable work surface 18.

It is preferred that the actuating portion 21 of the adjustment bar be oriented generally parallel to the lower surface of the work surface and be spaced from the lower surface of the work surface when the actuating mechanism is in the engaged position. Some deviation from a strictly parallel relationship is acceptable, and this is dependent upon the orientation of the adjustment bar when the notches 25 are fully engaged with the pins 36 as discussed below. For example, the adjustment bar can be oriented so that the back edge of the actuating portion can be about ¼ inch from the lower surface of the work surface and the front edge of the actuating portion about ½ inch from the lower surface of the work surface. Greater or smaller distances are acceptable, consistent with the functioning of the present invention discussed below. For example, the back edge of the actuating portion could be spaced about an inch from the lower surface of the work surface.

The actuating portion also should be disposed adjacent to an edge of the work surface, preferably the back edge of the work surface. The term "adjacent" is used to indicate that the user with hands of ordinary size would be able to reach his or her fingers around the edge of the table to apply pressure to the actuating portion and urge it towards the lower surface of the work surface. This movement of the actuating bar pivots the adjustment bar about pivot 23, thereby moving flanges 24.

As shown most clearly in FIG. 7, a pin 36 projects inwardly from opposing portions 38 of the frame. These portions 38 may be part of the uprights 12, or may be extensions attached to the uprights 12 or connecting members 14. Alternatively, portions 38 may be part of a free-standing platform that can be set on a desk top so that a conventional desk or work station may be retro-fitted with a tiltable work table in accordance with the present invention. The pins also may extend from the arm 16, and this embodiment would be especially advantageous for retro-fitting a conventional desk or work station with a tiltable work table.

The pins 36 are engageable with any selected pair of notches 25 of the flanges 24 of adjustment bar 22. Adjustment bar 22 is pivotably connected to the table so that the weight of the bar urges the adjustment bar to swing so that the notches are urged into engagement with the pins. In this way, the tilt angle of the work surface 18 can be adjusted by lifting the actuating portion of adjustment bar 22 to rotate flanges 24 so as to disengage notches 25 from pins 36, and then moving the work surface until the desired angle is achieved and a different pair of notches is aligned with the pins. Once the bar is released, the action of gravity urges the notches into engagement with the pins, thus setting the work surface at the desired angle. Alternatively, it would be possible to spring-load the bar to urge the notches into engagement with the pins. Moreover, it is desirable to avoid this if possible, since it increases the number of moving parts and increases the complexity of the manufacturing process.

Figure 8:
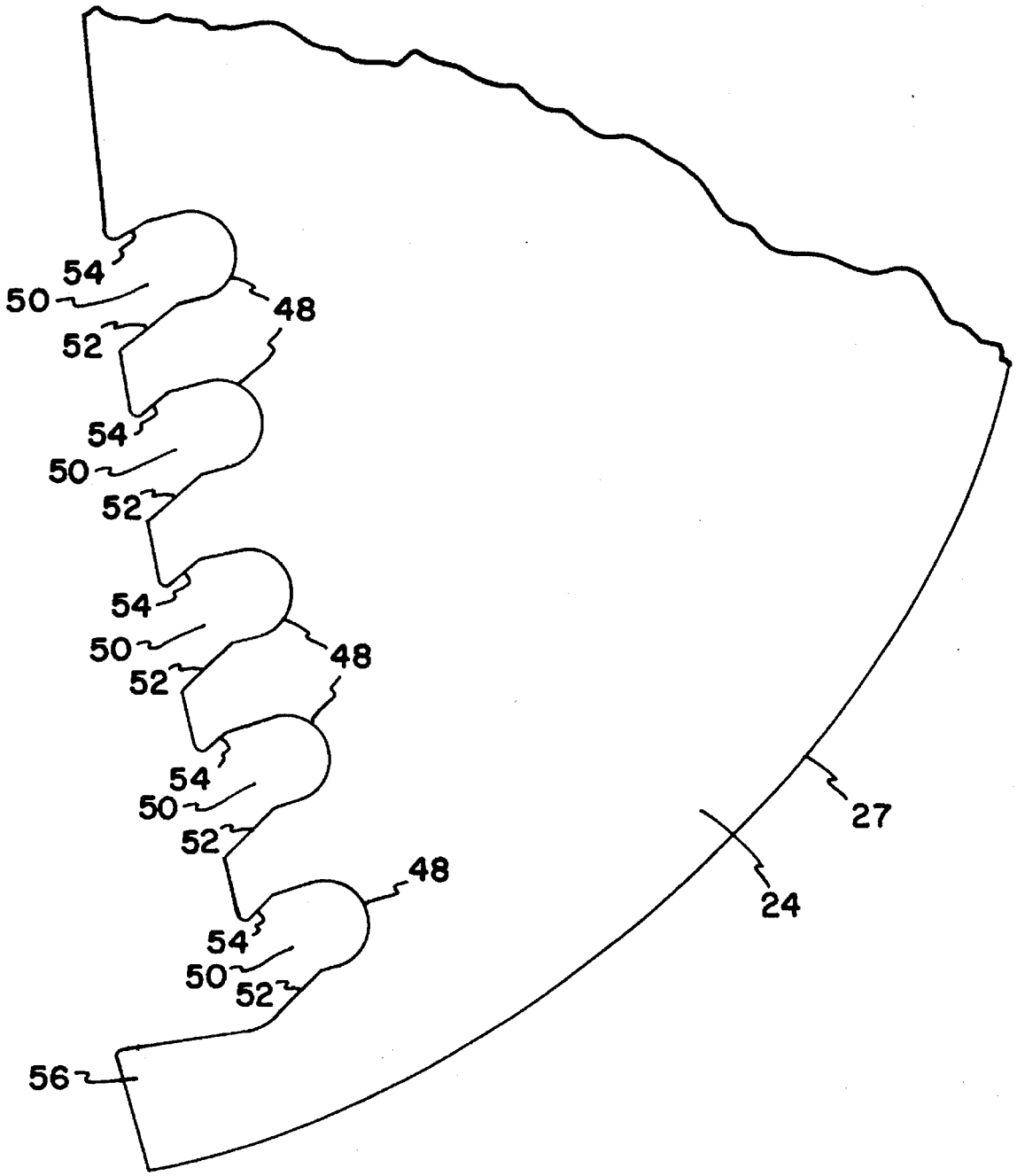
FIG. 8 is an enlarged partial side view of a side flange of the adjustment bar shown in FIG. 5.

Details of the shape of the notches are seen in FIG. 8. The notches include retaining portions 48 which are generally part-circular in shape. The shape and orientation of the retaining portions 48 are such that the upper and lower areas of the retaining portions are perpendicular to downward and upward forces generated by movement of or pressure on the work surface. Thus, when portions 48 are engaged with the pin, upward and downward movement of the work surface is resisted. The notches also have entry 50, defined by a flared bottom portion 52 and a hooked top portion 54. The flared bottom portion 52 improves the access of the pin to the notch. The hooked top portion helps in preventing disengagement of the pin from the notch until the user has control over the work surface, in a manner discussed below.

The actuating portion of the adjustment bar can be reached by the user from a seated or standing position by reaching with one hand around the edge of the work surface and lifting with the fingertips. The actuating portion of the adjustment bar where the user applies force to disengage the mechanism is flat and generally parallel to the lower surface of the work surface. The pivoting distance for disengagement is small, and the pivoting movement of the adjustment bar is limited by the distance between the lower surface of the work surface and the top of the bar.

The flanges 25, which include portion 24, are designed to resist disengagement. Preferably, the bar is made of a material which allows some flex in the actuating portion 21. If the user attempts to disengage the mechanism without first accepting and controlling the weight of the work surface, a situation which might result in the collapse of the work surface to the horizontal position, the hooked top portion of the notch will resist the disengaging of the pin, and the actuating portion will then flex through the narrow distance between the bar and the lower surface of the work surface, with the contact against the lower surface of the work table resisting further movement of the mechanism and preventing the disengagement of the mechanism. Only when the user lifts and controls the work surface while lifting on the bar will the mechanism disengage. In this case, the user has control of the surface. Upon release of the actuating portion, the adjustment bar automatically swings forward under the force of gravity across the short distance required to re-engage the pin with the desired notch. By way of example, an actuating portion made of 12 gauge cold rolled steel, which spans a distance of about 24.5 inches between the flanges and has a width of about 2.25 inches, with its back edge spaced about ¼ inch from the lower surface of the work surface when the notches engage the pins, exhibits sufficient flex to provide the above function.

As noted above, while it is desirable to form the adjustment bar from a single piece of material for ease of manufacturing, in some cases it may be desirable for the actuating portion to be made from a different material than the flanges. For example, it might be desirable to have the actuating material made of a certain material having a certain thickness for the flex characteristics, while the flanges might be made from a different material or have a different thickness for strength or to reduce costs.

The disengagement of the notches from the pins allows the user to move the work surface up and down to the desired angle represented by one of the notches. Protrusion 56 at the lower portion of the flange prevents the work surface from being moved beyond the location of the lowermost notch, since the protrusion 56 will engage the pin and prevent further movement of the work surface.

Figure 9:
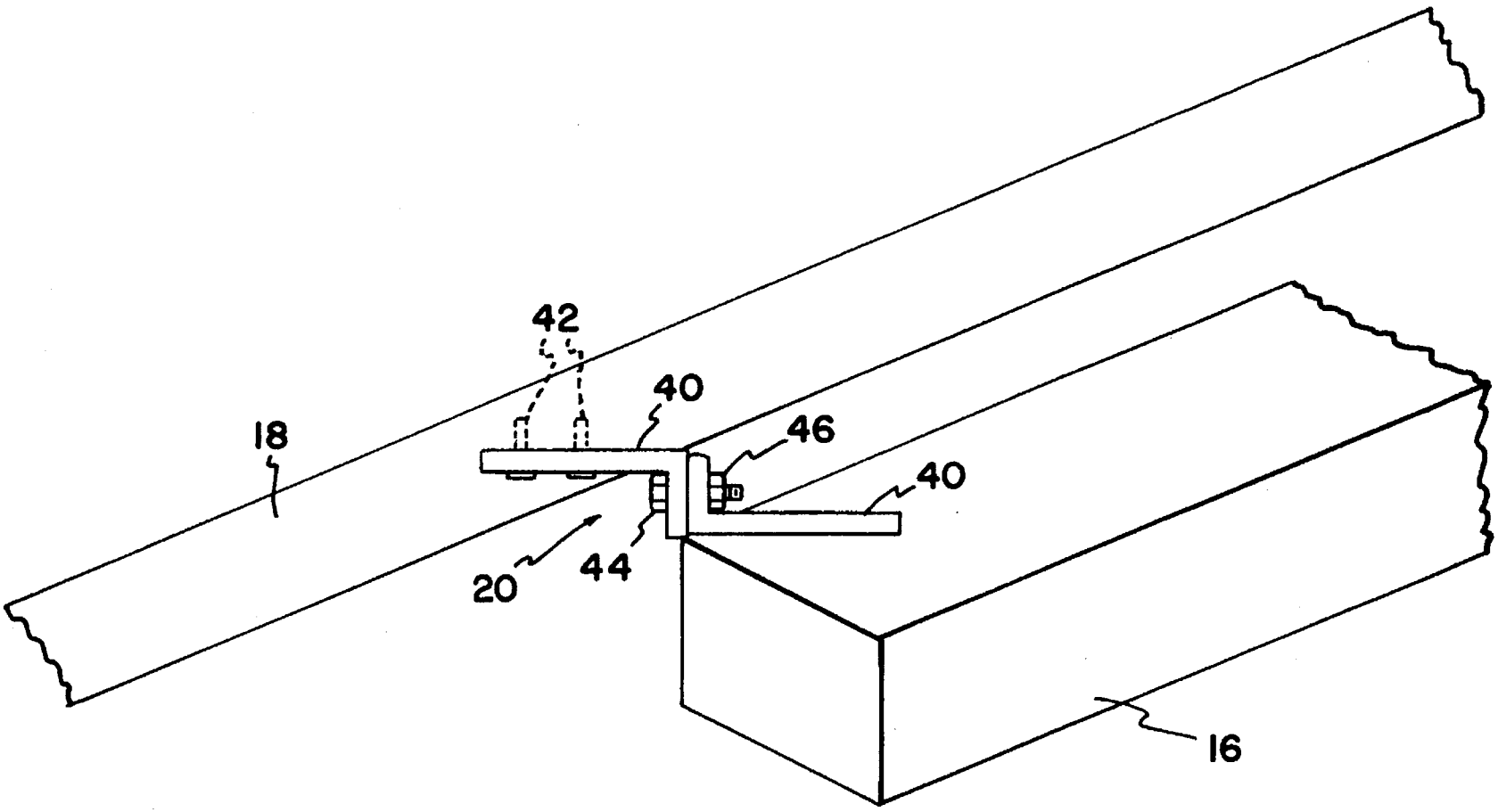
FIG. 9 is an enlarged partial side perspective view of a hinge used in the adjustment mechanism.

As shown in FIG. 9, each work surface pivot joint 20 may be formed of a pair of eye hole brackets 40, one of which is fixed to the underside of work surface 18 and the other which is fixed to arm 16. The brackets may be fixed with their respective supports in any suitable manner, for example, via screws as shown. If the arm is formed of a metal material, it may be advantageous to fasten the bracket to the arm by welding. A bolt 44 preferably extends through the holes in the eye hole brackets and is secured in place by using lock nut 46. In this way, the work surface 18 can pivot relative to the arms 16.

It is also preferable that the adjustment bar 22 extend across most of the width of the work surface. Because the adjustment bar extends only a short distance from the lower surface of the work surface, the actuating portion 21 will only minimally obstruct the user's knee space. The flexing action of the actuating portion can help prevent accidental disengagement of the mechanism if the actuating portion is inadvertently hit by the user's knee. In addition, the flanges 24 and pins 36 will then be located at a relatively remote location with respect to the user's legs, reducing the chances of injury or discomfort.

It is also desirable for the work surface to be pivotably supported at a relatively central location between the front and back portions, i.e. a longitudinally central location. This tends to balance the weight of the work surface and make the work surface easier to control during the adjustment process. It is desirable to have the work surface pivotably supported at a location somewhere in the middle 50% of the work surface with respect to the front and back edges, i.e. from 25% to 75% of the distance from the front edge to the back edge. As noted previously, the notches 25 are shaped to resist both downward pressure exerted by the work surface and objects placed thereon, as well as upward pressure which might be caused by a user leaning on the front edge of the work surface.

The above is for illustrative purposes only. Modifications may be made, particularly with regard to size, shape and arrangement of parts, and still be within the scope of the invention as defined by the claims appended hereto. For example, instead of notched flanges being provided on the adjustment bar and pins being attached to the support, notched plates could be attached to the support and the adjustment bar could be provided with a pin to engage the notches in the plate.

What is claimed is:

1. A work station, comprising;

a support frame;

a work surface pivotably mounted on the support frame, having upper and lower surfaces;

an adjustment bar on the lower surface of the work surface, pivotably secured to the work surface, the adjustment bar comprising (a) an actuating portion which is oriented generally parallel to the lower surface of the work surface, is spaced from the lower surface of the work surface, and is disposed adjacent an edge of the work surface and (b) an engaging portion having an edge which is provided with a plurality of notches; and a pin projecting from the support frame for engaging any one of the plurality notches;

the adjustment bar being pivotably secured to the work surface so that movement of the actuating portion toward the lower surface of the work surface can disengage the pin from one of the plurality of notches to allow the work surface to be set at a different angle by engaging the pin with a different notch, and upon release of the bar the edge of the engaging portion having the notches will be urged in a direction toward the pin.

2. A work station as claimed in claim 1, wherein the notches are shaped to resist disengagement from the pin due to both upward force and downward force.

3. A work station as claimed in claim 2, wherein the work surface is pivotably mounted on the support frame at a longitudinally central position of the work surface.

4. A work station as claimed in claim 1, wherein the notches permit the work surface to assume an orientation in the range from horizontal to about 13 degrees from horizontal in either direction.

5. A work station as claimed in claim 1, wherein the engagement portion comprises a movement-limiting protrusion on the edge having the notches.

6. A work station as claimed in claim 1, wherein the work surface has a first side that in use is adapted to be a user's position and the actuating portion of the adjustment bar is disposed adjacent an edge of the work surface which is distal with respect to said first side.

7. A work station as claimed in claim 1, wherein the adjustment bar has a thickness and is made of a material which renders the actuating portion capable of flexing, whereby upon attempting to pivot the adjustment bar without relieving the weight of the work surface from the notch and pin, the actuating portion will flex until it contacts the lower surface of the work surface, without permitting the disengagement of the pin from the notch.

8. A work station as claimed in claim 1, wherein the actuating portion of the adjustment bar extends substantially across the width of the work surface.

9. A work station as claimed in claim 1, wherein a flange extends perpendicularly from each end of the actuating portion, each of the flanges having a plurality of notches, the frame having a pin for each flange.

10. A work station as claimed in claim 1, wherein the support frame comprises a pair of arms, each of the arms having a pivot joint for pivotably connecting the work surface to the frame.

11. A work station as claimed in claim 1, wherein the notches are urged toward the pin by the action of gravity.

12. A work station, comprising:

a support frame;

a work surface pivotably mounted on the support frame at a longitudinally central portion of the work surface, having upper and lower surfaces;

an adjustment bar on the lower surface of the work surface, pivotably secured to the work surface, the adjustment bar comprising (a) an actuating portion which is oriented generally parallel to the lower surface of the work surface, is spaced from the lower surface of the work surface, extends substantially across the width of the work surface and is disposed adjacent an edge of the work surface which is distal with respect to a side of the work surface where a user would be located, and (b) an engaging portion which extends generally perpendicularly to the lower surface, the engaging portion comprising flanges which extend perpendicularly from ends of the actuating portion, each of the flanges having an edge which is provided with a plurality of notches and a movement-limiting protrusion; and a pair of pins projecting from the support frame for engaging any one of the plurality notches in each of the flanges, the notches being shaped to resist disengagement from the pins due to both upward force and downward force, the notches permitting the work surface to assume an orientation from about horizontal to about 13 degrees from horizontal in either direction;

the adjustment bar being pivotably secured to the work surface so that movement of the actuating portion toward the lower surface of the work surface can disengage the pins from their notches so that the work surface can be set at a different angle by engaging the pin with a different notch, and upon release of the bar the edges of the flanges having the notches will be urged by the action of gravity in a direction toward the pins, wherein the adjustment bar has a thickness and is made of a material which renders the actuating portion capable of flexing, whereby upon attempting to pivot the adjustment bar without relieving the weight of the work surface from the notches and pins, the actuating portion will flex until it contacts the lower surface of the work surface, without permitting the disengagement of the pins from the notches.

* * * * *